US008809656B2

(12) United States Patent
Radosevich

(10) Patent No.: US 8,809,656 B2
(45) Date of Patent: Aug. 19, 2014

(54) ACOUSTIC DRUM HEAD TUNING SYSTEM AND METHOD OF USE

(76) Inventor: Paul Thomas Radosevich, Dayton, MN (US)

( * ) Notice: Subject to any disclaimer, the term of this patent is extended or adjusted under 35 U.S.C. 154(b) by 0 days.

(21) Appl. No.: 13/066,238

(22) Filed: Apr. 11, 2011

(65) Prior Publication Data

US 2012/0255421 A1 Oct. 11, 2012

(51) Int. Cl.
*G10D 13/02* (2006.01)

(52) U.S. Cl.
CPC ..... *G10D 13/023* (2013.01)
USPC ..... 84/413

(58) Field of Classification Search
USPC ..... 84/411 R, 413
See application file for complete search history.

(56) References Cited

U.S. PATENT DOCUMENTS

| | | | | |
|---|---|---|---|---|
| 5,385,076 | A | 1/1995 | Belli | |
| 5,392,681 | A * | 2/1995 | Hall | 84/413 |
| 5,522,961 | A * | 6/1996 | Leonhardt | 156/252 |
| 6,483,017 | B1 * | 11/2002 | Dill et al. | 84/411 R |
| 6,515,208 | B2 * | 2/2003 | Cleland | 84/411 R |
| 7,159,608 | B1 * | 1/2007 | Lucas et al. | 137/341 |
| 7,786,370 | B2 * | 8/2010 | Ludwig | 84/645 |
| 8,148,618 | B1 * | 4/2012 | Vaden | 84/411 R |

* cited by examiner

*Primary Examiner* — Kimberly Lockett
(74) *Attorney, Agent, or Firm* — DeFault Law Firm, P.C.; Dustin R. DeFault

(57) ABSTRACT

The present invention enhances acoustic drum tone quality with consistently clear high-definition sound while introducing a 3-dimensional, real-time pitch change capability to any size or style or number of drums. The present invention also enables the production of an endless array of fully acoustic percussive musical effects, such as clear polyphonic tuning pitch bends, clear chord progressions and clear harmonies, all while performing in real-time. The present invention easily installs and operates on any size or style or number of drums while adding a clearly tuned and accurately pitched, fully acoustic dynamic to percussion performance.

18 Claims, 4 Drawing Sheets

ACOUSTIC DRUM HEAD TUNING SYSTEM AND METHOD OF USE

BACKGROUND OF THE INVENTION

In the field of musical performance, percussive instruments comprising of various types and styles of drums are used to communicate the rhythm of a musical piece being played by producing a variety of audible beats on command by a percussionist or drummer. The present invention relates to an acoustic drum head tuning system. More precisely, the present invention relates to a pneumatic system that operates an inclusive distensible annular bladder that is positioned a continuous 360° at the outer periphery of a drum head whereby increasing, maintaining or reducing the regulated pressure of a compressed gas contained within the bladder uniformly increases, maintains or reduces bladder displacement, which uniformly increases, maintains or reduces applied tension evenly on all points of the head playing surface which thereby produces an acoustically clear and pleasant sounding uniform pitch that is easily and uniformly raised, maintained or lowered, at any time at the drummer's command, even while performing a musical piece.

A more detailed examination of the prior art and conventional percussive instruments and drums reveals that commonly there exists an array of non-uniform mechanical irregularities in drum head support systems. Non-uniform mechanical irregularities produce a non-uniform resonation of a drum head when it is struck. Non-uniform resonation of a drum head produces sound that includes inharmonic dissonant acoustical overtones and mixed sour pitches that are unpleasant sounding to the human ear. The unpleasant sound produced is similar to that which is heard from stringed musical instrument such as a violin being played when it is out of tune.

Further, when properly tuned the sound produced from a drum will carry a specific pitch or note that is found on the musical scale. Percussionists and drummers continually strive to tune all drum heads as close as possible to uniformly resonating at specific pitches so each drum head will harmonize or sound in concert with other drum heads as well as with other musical instruments involved in a particular musical performance.

In any conventional percussion instrument such as a snare drum, tom, or bass drum, as well as in timpani, timbale, conga or djembe, the drum consists of a hollow, often cylindrical shell with or without openings that are commonly located at opposing ends. One or both openings are commonly covered by a drum head made from a thin polymer film or skin. Each drum head is commonly retained against the end, or sound edge, of the hollow cylindrical shell by a metal rim. Commonly, the drum head includes a rigid circular hoop at its outermost periphery which extends over the end or sound edge of the shell providing a surface for the rim to secure and move the hoop so that the drum head is tensioned more or less over the sound edge. The rim is secured in place and has its tension against the hoop adjusted by a plurality of threaded tension rods evenly spaced around the rim that thread into correlating lugs that are fixed to the outside of the shell. Tension is applied either tighter or looser with a special drum key used to adjust head tension by hand, doing so in small alternating incremental adjustments to each of the tension rods. A higher pitch is produced by the drum head in the area nearest to each individual tension rod as it is tightened or advanced. Conversely, a lower pitch is produced by the drum head in the area nearest to each individual tension rod as it is loosened or retracted.

Conventional drums commonly consist of one or two opposing drum heads. The drum head located closest to the drummer and most commonly played is referred to as a batter head since it is the one that is commonly struck by an object, such as a drum stick, mallet or beater. The opposing drum head located furthest from the drummer is referred to as a resonating drum head which resonates producing a combined audible sound as it is impacted by the sound waves that are generated by the batter head. In such a case, when the batter head is struck, both drum heads resonate simultaneously producing a harmonic or inharmonic sound. Occasionally, a batter head is used on a drum without the use of an opposing resonating drum head to produce a flatter sound with a lesser depth of resonance.

The major problem with conventional acoustic drum head tuning occurs as percussionists and drummers strive for clear acoustic drum head tuning to specific pitches, achieving this continually evades them due to a combination of mechanical and atmospheric factors. Conventional acoustic drum head tuning has always been a time consuming process that is viewed by many as a highly skilled art. Continual efforts are made by drummers to tension heads uniformly by hand and by ear to minimize the degree of non-uniform head tension, non-uniform head resonation, and the presence of unpleasant inharmonic dissonant acoustical overtones and mixed sour pitches that are undesirable to the human ear when the head is struck. Clear sounding, uniformly tensioned and pitched conventional drum head tuning requires an advanced level of experience, skill and musical talent that involves tapping the drum head near each tension rod to hear the sound generated in that area as compared to the areas adjacent to the other tension rods. The drummer must first tap the head, listen and then tighten or loosen each tension rod using a special drum key in order to approach a desired pitch that is closer to matching the others throughout the drum head. While adjusting one tension rod, the adjustment has an influence on the settings of all of the other tension rods on the same head. Drum head tuning to match a desired pitch requires many minor incremental adjustments to every tension rod on each drum head. Any desired change in the pitch of any drum head, once again requires many minor incremental readjustments to every tension rod on each drum head.

In addition to this tedious process, when a drum has two heads, the bottom resonant head must be tuned to precisely correspond with the top batter head. The precise matching of all tensions, all tones and pitch that is produced by the top batter head, with all tensions, all tones and pitch that is produced by the opposing bottom resonant head on the same drum is nearly impossible when using the conventional method of hand tuning. Bottom drum head tuning is often neglected since they are typically located away from the drummer in a position where access is limited.

It is also common to desire that the pitch of each drum head will harmonize in concert with the pitches of other drums in the same set, as well as with other musical instruments used of a particular musical style or performance.

Further, where marching bands or drum corps will commonly use any number of the same sizes and style of drum in marching lines or formations, it is common practice to attempt matching all tensions, all tones and all pitches of all heads.

Advanced drummers commonly would like the ability to bend or change the notes or precise pitches of their drum heads fast and easy, or in real-time, while creatively playing, in a fashion similar to that of a string or wind instrument such as a guitar or saxophone. Conventional drum head tuning cannot be accomplished fast and easy, between musical pieces or in real-time while one is playing the drums.

Conventional drums are mechanical devices that consist of manufactured parts and hardware which are made with manufacturing tolerances that combine to produce negative influences on uniform head tension, head resonance and the final sound quality of a drum head. Poor sound quality is especially evident in cheaply manufactured drums; old used drums with bent rims, warped shells, or disfigured shell sound edges or dented worn-out heads. Also, changes in atmospheric conditions local to the drum, including; temperature, relative humidity and barometric pressure causes changes to head tension. Mechanical imperfections of conventional drums, plus varying atmospheric conditions local to the drum all combine to have negative influencing effects on drum head tuning and the quality of sound produced.

One development in the concept of quick-tuning drums is called a Roto-Tom. This type of instrument usually has only one batter drum head held against a cast metal ring by a rim, which rim pulls the head tightly against the metal ring. Unique to this design are the tension rods spaced around the hoop, because when the entire drum is rotated, the tension rods collectively tighten and pressure the drum head against the ring, still having individually set tension rods. As a result, rotating the drum in one direction generally tightens the head tension and counter-rotating the drum generally decreases the head tension. These are specially made one-headed drums having no shell or opposing resonating drum head which will produce a flatter sound with less depth of resonance.

One method of quickly changing the pitch of drums is disclosed in U.S. Pat. No. 3,590,680 to Carnes et al. Carnes discloses an apparatus for changing the pitch of a drum by conducting pressurized gas into the interior of the drum. Thus, when the drum is pressurized, the pitch is raised; lowering the gas pressure lowers the pitch. However, conventional drums are not air-tight pressure-rated vessels. Make-up air would be needed to maintain any pitch due to the continual air leakage and excessive internal pressures inside any conventional drum will cause it to explode.

There have been other attempts at using air to affect the pitch of a drum. For instance, U.S. Pat. No. 3,240,096 to Sloan discloses a pneumatic drum head tightener. Sloan uses an annular vellum, inflated with air, which is stretched around the circumference of the drum and acts somewhat as a shock absorber. This device has no practical means for simple application to existing conventional drums.

U.S. Pat. No. 3,541,913 to Severino discloses an inflated tube that is incorporated into the outside shell of a drum in order to facilitate easy replacement of the drum head. When the captive tube is inflated, it pulls down a collar which acts on the drum head to tighten or loosen the same. This device, however, requires specialized and complicated hardware in order for the inflatable tube to operate properly. This device has no practical means for simple application to existing conventional drums.

Another example of pneumatic operated device is disclosed in U.S. Pat. No. 5,392,681 to Hall disclosing an apparatus for changing the pitch of a drum by an annular distensible bladder in the form of a length of hose, containing air and having a valve connected to a pump. Thus, when air is pumped into the bladder, the bladder expands stretching the drum head over the shell. This device contains several serious flaws, including the annular distensible bladder which is actually not completely annular 360° about the drum head. Rather, it is a length of hose with one closed end and the other end connected to an optional feed line. However, to perform the task of tensioning a drum head in a completely uniform fashion, it is imperative the annular distensible bladder is one continuous member completely annular 360° about the drum head perimeter. This example fails to accomplish this necessary function. The bladder (or rather length of hose) in this device is incomplete and inconsistent in distensible cross-section at both ends in comparison to its body, which in use will apply inconsistent non-uniform tension to the drum head thereby rendering the intended function as flawed. A collection of components including an electric compressor, control valve, valve stem, pump, foot operated bellows, optional feed lines, control and bleed valves is listed as possible methods of controlling the device with no clear definition of actual method of operation for the device or alternative embodiments. The absence of a practical method of operation that is simple to install, quiet and easy to use in a musical production or performance setting renders this device impractical and unusable.

In view of the foregoing, percussionists and drummers are musicians who need a simple and practical acoustic drum head tuning system that accomplishes precise acoustic drum head tuning with ease, speed and musical versatility, producing clear resonant harmonic drum sound at any desired pitch. A drum head tuning system that installs easily on any conventional drum, will operate easily and silently while hidden from view, and must enhance creative musical drum sound.

SUMMARY OF THE INVENTION

Therefore, in view of the foregoing, it is an object of the present invention to provide an acoustic drum head tuning system that is easily assembled into the existing hardware of any style of conventional acoustic drum while requiring no special modifications or involve the addition of cumbersome hardware. It is another object of the present invention to tension any style of conventional acoustic drum head uniformly across its entire surface so that it resonates uniformly when struck by hand, object or sound wave to produce a uniform sound that is clear in pitch for a high-definition sound quality. It is another object of the present invention to provide an easy method of raising or lowering the clear audible pitch produced by any style of conventional acoustic drum quickly and easily, at any time or in real-time at the will of the drummer or percussionist, even while the drum is being played to add a 3-dimension drum sound quality. It is another object of the present invention to allow ease in precision tuning adjustment for matching of clear audible pitch on any number of similar sized drum heads that are located on the same or on separate drums. It is another object of the present invention to allow ease in precision adjustment for matching or harmonizing the clear audible pitch produced by any number of drum heads that are located on the same or on separate drums. It is another object of the present invention to perform its function in a nearly silent and nearly unseen manner that does not interrupt the musical production or performance. It is another object of the present invention to provide an acoustic drum head tuning system that is operated by a fluid, preferably an easily attainable, compact and long lasting compressed gas such as $CO_2$.

In order to achieve the forgoing objects, the present invention provides in the preferred embodiment and alternates, an acoustic drum head tuning system for use on any type of conventional acoustic drum. The present invention includes a system for regulating the pressure of a compressed gas such as air or $CO_2$ that is contained within a 360° continuous distensible annular bladder which is located at the periphery of each drum head.

When regulated air pressure within the 360° continuous distensible annular bladder is increased, the bladder expands 100% uniformly 360°. The uniform bladder expansion propels the hoop uniformly axially and thereby uniformly increases applied uniform tension to the drum head over the end of the shell and thereby raises the pitch that the head produces when struck. Conversely, when regulated air pressure within the 360° continuous distensible annular bladder is decreased, the bladder contracts 100% uniformly 360°. The uniform bladder contraction retracts the hoop uniformly axially and thereby uniformly decreases applied uniform tension to the drum head over the end of the shell and thereby lowers the pitch that the head produces when struck. The effecting regulated air pressure of the present invention can be held within the 360° continuous distensible annular bladder at any pressure desired, which maintains the pitch it produces when struck. Regulated air pressure within the 360° continuous distensible annular bladder of the present invention is consistently uniform 360° at all points, (such as uniform pressure occurs in a common pneumatic tire) resulting head tension is thereby consistently uniform 360° at all points, resulting clear tone and pitch quality is consistently uniform while raising, holding or lowering the regulated air pressure within the 360° continuous distensible annular bladder of the present invention.

In an alternative embodiment, the present invention is adapted to locate the 360° continuous distensible annular bladder between the shell and the head. In this alternative embodiment, the annular bladder moves only the head and does not move the hoop with respect to the rim to perform its function of applying a uniform 360° head tension. This alternate location is of particular advantage for use on drums such as djembe, bongos, conga or timpani. All other details of the present invention and its method of use remain unchanged in this alternative embodiment.

In another alternative embodiment, the present invention is adapted to fit both opposing heads of a two-head drum, where both heads include 360° continuous distensible annular bladders which are located at the periphery of each drum head, specifically located a complete 360° while residing between each hoop and each rim. While both bladders are connected to a common air source the pitch of both heads is controlled concurrently. The addition of a second air pressure regulator connecting to the second bladder allows independent pitch control of each of the two opposing heads.

In another alternative embodiment, the present invention is adapted to fit any number of heads on any number of drums. One 360° continuous distensible annular bladder is placed between each hoop and each rim on each drum head. With all bladders connected to a common air source, the pitch of all heads can be controlled concurrently.

In another alternative embodiment, the present invention is adapted to use any style or combination of air pressure regulators that are operated by hand, foot, mouth or electronic signal to control the level of regulated air pressure that is contained within the 360° continuous distensible annular bladder or bladders.

In another alternative embodiment, the present invention is adapted to use a reservoir or tank as the source of compressed air, with or without a pump, where the compressed air supply connects to the secondary pressure regulator of the preferred embodiment, replacing the CO2 cylinder and its primary regulator.

The present invention thus provides a combination of several advantages over the prior art, most of them are provided simultaneously; First, a fully acoustic drum head tuning system that easily incorporates into any style of pre-existing, conventional drum that adds a new high-definition, clear sounding dynamic when it is played by providing a continuous 100% uniform drum head tension 360° which produces a 100% uniform head resonance which provides a clearly audible and desirable sound that is free of inharmonic dissonant acoustic overtones and mixed sour pitches for high-definition sound. Second, the present invention allows the tonal pitch change of any style of pre-existing conventional acoustic drum quickly, easily, at any time or in real-time, even while playing to provide a clearly audible and desirable control of acoustic drum head pitch change, or 3-dimension sound. Third, the present invention enables the precise matching of tonal pitch on any number of similar size drum heads on the same drum or separate drums. Forth, the present invention allows the precise harmonizing of tonal pitch of any number of similar size drum heads on the same drum or any separate drums. Fifth, the present invention performs its function in a silent and hidden manner. Sixth, the present invention provides an acoustic drum head tuning system that is operated by a fluid, preferably air in an easily accessible CO2 liquid form. Seventh, the present invention provides an acoustic drum head tuning system that does not require specialized modifications or addition of cumbersome hardware. Eighth, the present invention allows a precise acoustic drum head tuning system that can simultaneously tune and vary the pitch of any number of similar size drum heads on the same drum or any separate drums. Ninth, the present invention compensates for drums having; worn-out heads, damaged sound edges and warped rims or shells, while entirely eliminating the need for the addition of external drum head isolation mounts.

DESCRIPTION OF THE PREFERRED EMBODIMENT

Figure 1:
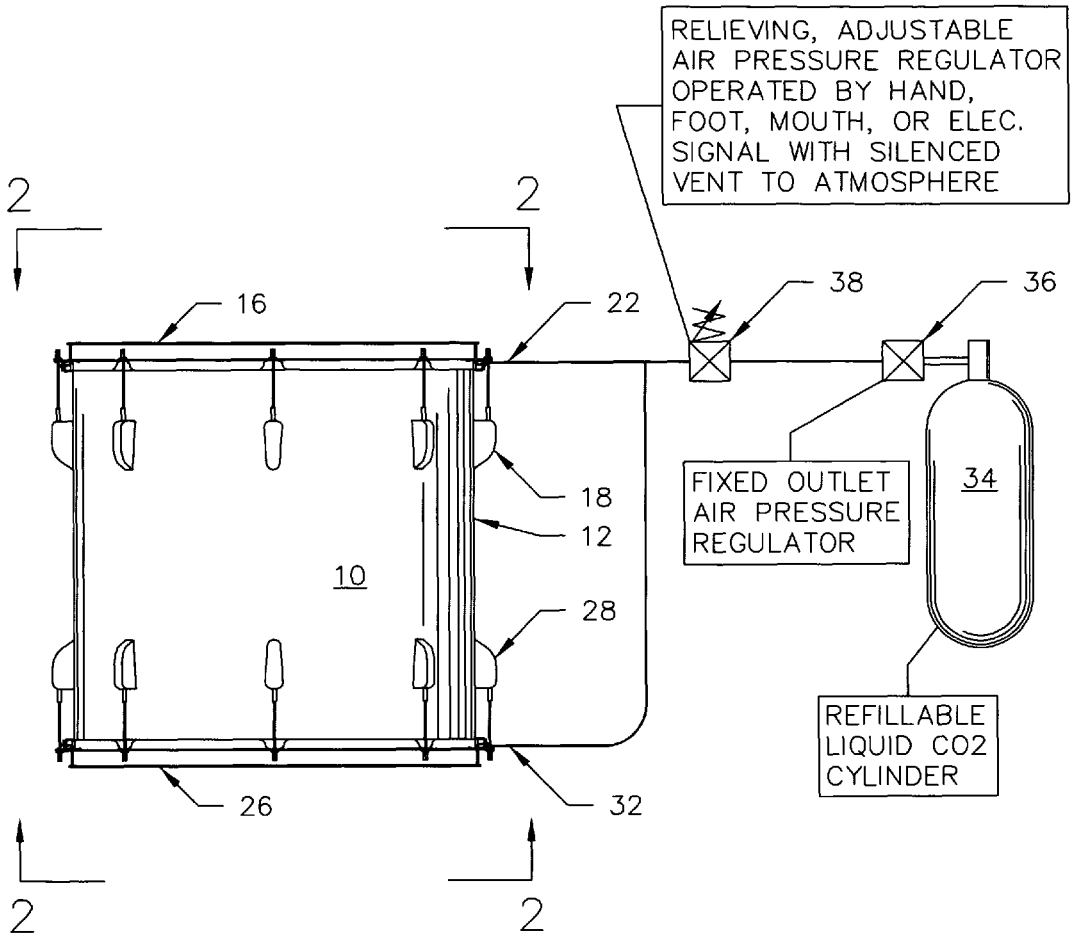
FIG. 1 is a side-view of a drum having two heads and regulated air supply.
Figure 2:
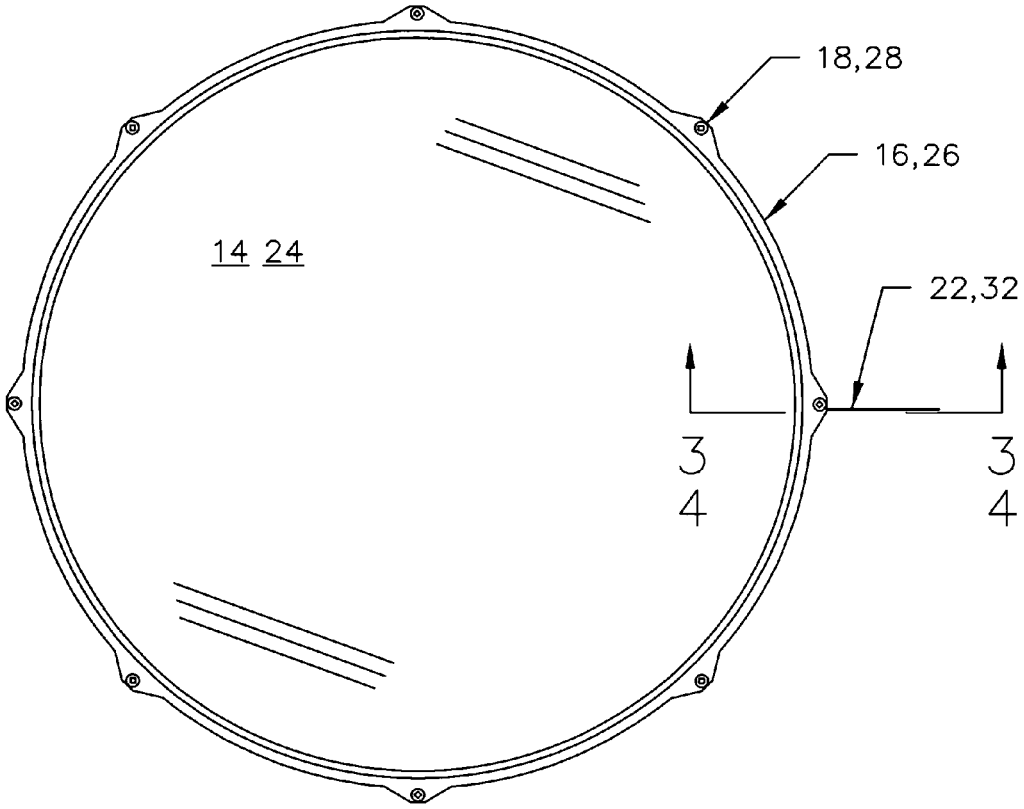
FIG. 2 is either end-view of a the same conventional drum, 2-2 of FIG. 1
Figure 3:
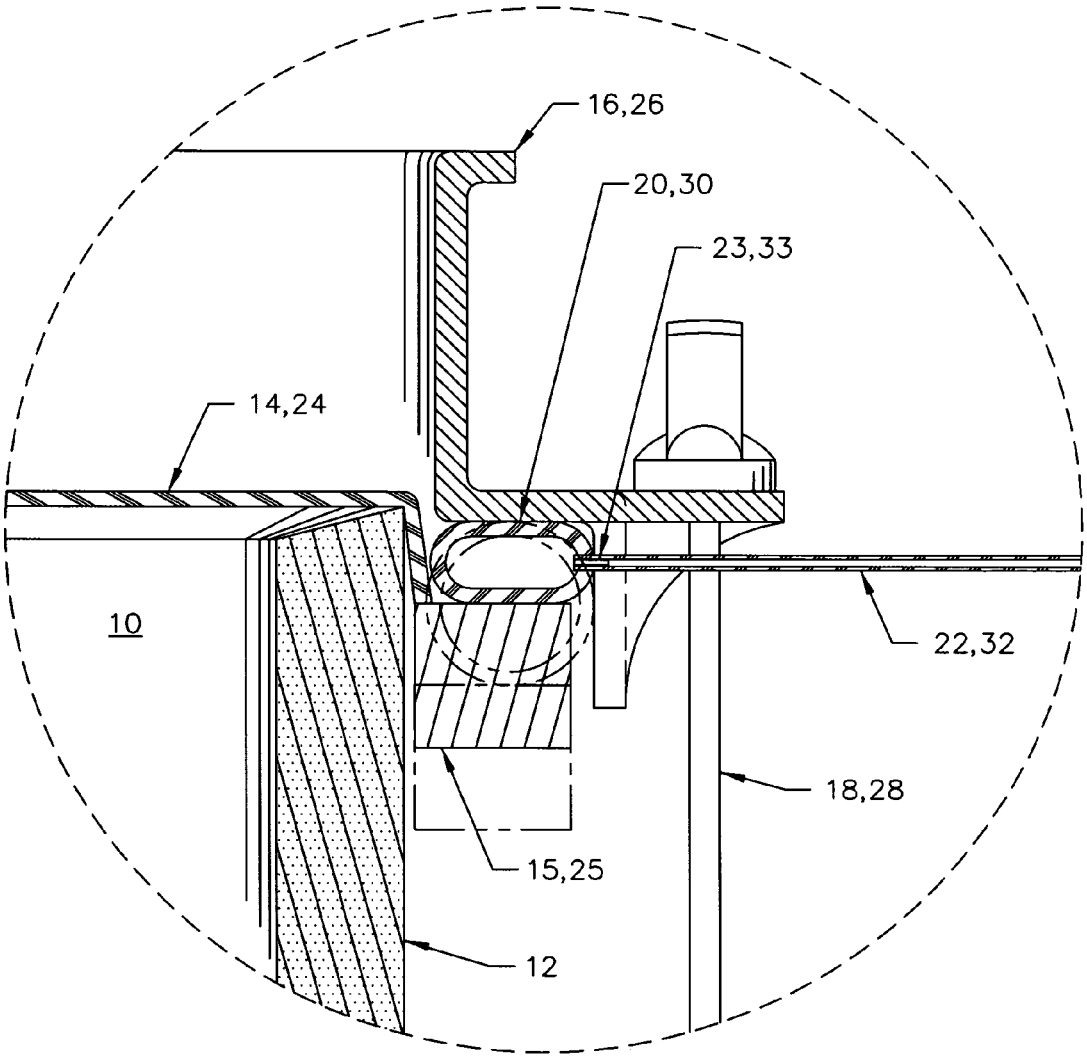
FIG. 3 is a section-view of the distensible annular bladder, 3-3 of FIG. 2

A conventional acoustic drum 10, is comprised of a cylindrical shell 12, has a batter head 14, with hoop 15, rim 16, and plurality of tensioning lugs 18. The present invention includes the addition of a 360° continuous annular distensible bladder 20, located between hoop 15, and rim 16, has an air pressure conduit connection 22, with an internal, crush-resistant fitting 23.

A conventional acoustic drum 10 is also commonly comprised of an opposing resonant head 24, with hoop 25, rim 26, and plurality of tensioning lugs 28, located at opposing end of the cylindrical shell 12. The present invention includes the addition of a 360° continuous annular distensible bladder 30, located between hoop 25, and rim 26, has an air pressure conduit connection 32, with an internal, crush-resistant fitting 33.

The present invention includes a 360° continuous annular distensible bladder 20, 30, located between hoop 15, 25, and rim 16, 26, having an air pressure conduit connection 22, 32. Operation is performed by externally adjusting the regulated air pressure contained within bladder 20, 30, to various elevated pressure levels that are higher than the surrounding atmospheric pressure. A practical regulated air pressure range is from 0 to 100 PSIG, where 0 PSIG results in a fully deflated bladder 20, 30, and 100 PSIG results in a fully inflated bladder 20, 30. Regulated air pressure within the bladder 20, 30, is precisely the same at any point within. Any regulated pressure level between 0 and 100 PSIG results in a proportional percentage of fully uniform inflation of bladder 20, 30, resulting in a proportional percentage of fully uniform tension applied to head 14, 24. The sound produced by the head 14, 24, is uniform and clear, free of inharmonic dissonant acoustical overtones and mixed sour pitches that are undesirable to the human ear when the drum 12, is played.

The practical and silent air pressure control system used to perform the operation of the present invention includes a compressed air or liquid CO2 reservoir 34, containing a surplus of compressed air that is greater than 100 PSIG. A primary fixed-outlet air pressure regulator 36 delivers compressed air at a reduced air pressure that is practical for delivery to an adjustable air pressure regulator 38, having an adjustable outlet air pressure range from 0 to 100 PSIG. The adjustable air pressure regulator 38 is a relieving type regulator that silently exhausts elevated down-stream air pressures to atmosphere when the air pressure setting adjustment is reduced. The adjustable pressure regulator 38 can be operated by hand, foot, mouth, or electric signal, according to operator preference. Multiples of pressure regulators 38 or electronically controlled regulators 38 may also be used in a series or parallel combination according to operator preference.

Increasing the air pressure within bladder 20, 30, inflates bladder 20, 30, moves hoop 15, 25, away from fixed rim 16, 26, thereby increases uniform tension annularly applied 360° to head 14, 24, over end of shell 12, and thereby uniformly raises the clear uniform pitch that is produced by head 14, 24 when it is played.

Conversely, decreasing the air pressure within bladder 20, 30 deflates bladder 20, 30, moves hoop 15, 25, closer to fixed rim 16, 26, thereby relaxes uniform tension annularly applied 360° to head 14, 24, over end of shell 12, and thereby uniformly lowers the clear uniform pitch that is produced by head 14, 24 when it is played.

Further, holding or maintaining the air pressure within bladder 20, 30, holds hoop 15, 25, in position with fixed rim 16, 26, thereby maintains uniform tension annularly applied 360° to head 14, 24, over end of shell 12, and thereby uniformly maintains the clear uniform pitch that is produced by head 14, 24 when it is played.

Also, bladder 20, 30, isolates head 14, 24, from most negatively influencing mechanical imperfections, such as; shell 12, flexing from drum 10 mounting, out of round or warped shell 12, out of round or bent rim 16, 26, dented or abused head 14, 24, or other disrupters to uniform tension annularly applied 360° to head 14, 24.

Air pressure conduit connection 22, 32, connects the air pressure controls to the 360° continuous annular distensible bladder 20, 30 with a tubular shaped internal crush-resistant fitting 23, 33, to prevent the connection from being pinched closed during use. Conduit connection 22, 32, is bonded, vulcanized or molded to bladder 20, 30, such that it is strong enough to contain 0-100 PSIG internal air pressure.

The 360° continuous annular distensible bladder 20, 30 is a flexible, tubular polyurethane elastomeric construction that is bonded, vulcanized or molded, such that it is strong enough to contain 0-100 PSIG internal air pressure. The annular diameter of the bladder 20, 30 matches that of industry standard head 14, 24 sizes such that the bladder 20, 30 easily fits between industry standard sized hoop 15, 25 and industry standard sized rim 16, 26.

Figure 4:
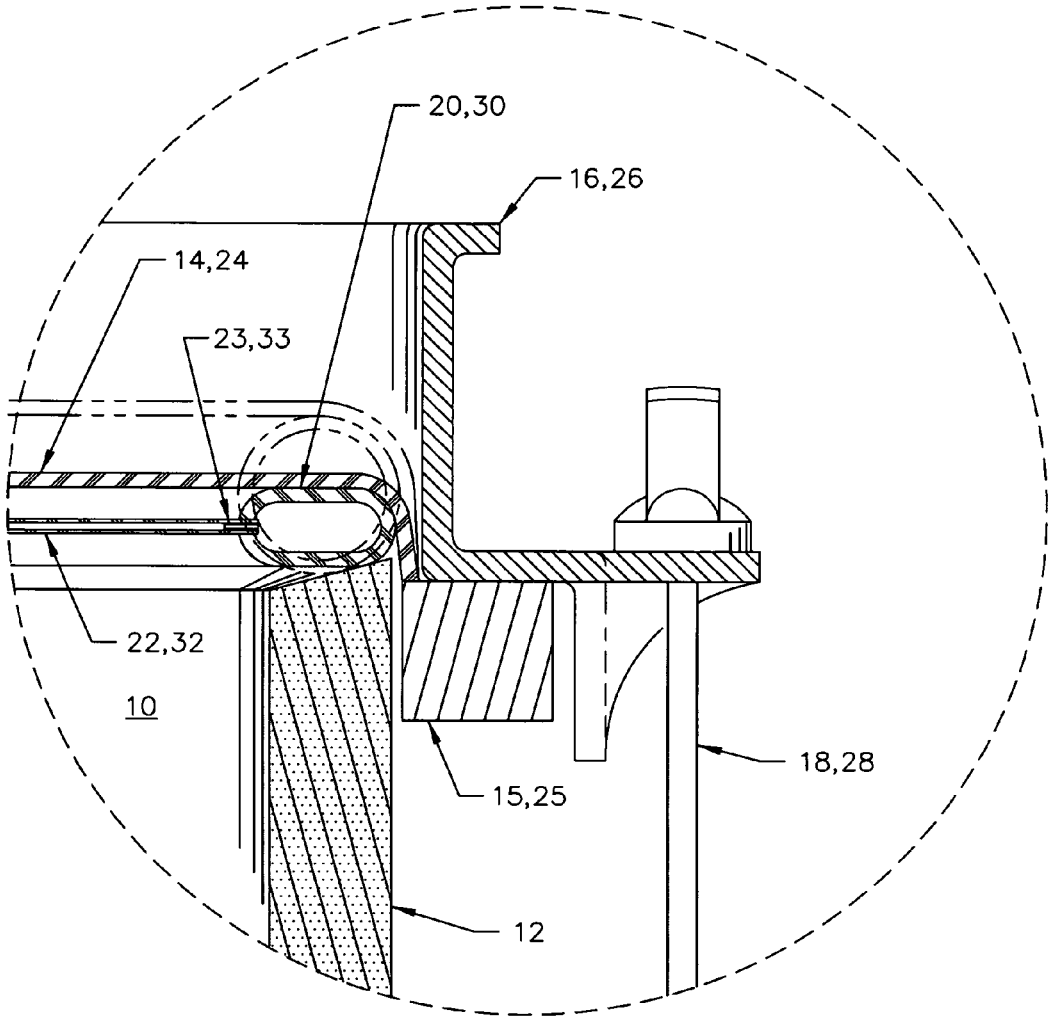
FIG. 4 is a section-view of the alternate location for the bladder, 4-4 of FIG. 2

An alternate location for the 360° continuous annular distensible bladder 20, 30, is shown in FIG. 4 where an acoustic drum 10, having a custom sized shell 12, such as is commonly present in conga, bongo, djembe or timpani, will accommodate bladder 20, 30, at end of shell 12. Bladder 20, 30, is positioned between end of shell 12, and head 14, 24. While the principal function and method of use of the present invention remain unchanged, this alternate bladder 20, 30, location allows a more direct influence on the range of uniform tension applied to head 14, 24, which may result in a broader scale of possible pitch range produced. This alternate location commonly requires a custom made bladder 20, 30, that has an annular diameter that will match the diameter of the custom sized shell 12.

Although the present invention has been described herein with reference to preferred and alternate embodiments, workers skilled in the art will recognize changes may be made in form and detail without departing from the spirit and scope of the present invention.

What is claimed:

1. A modular assembly for use with an acoustic style musical drum assembly having one or two drum heads to assist in the uniform distribution of tension applied to the drum head for the purpose of producing a clear and uniform frequency pitch when the drum head is struck by any object or sound waves, the modular assembly comprising:

a 360° continuous distensible annular bladder which conforms its profile shape relative to a regulated delivery of a compressed air pressure introduced within said bladder at pressures ranging from 0- 100 PSIG relative to an atmospheric pressure local to the bladder, said bladder disposed between a rim and a hoop, the rim and hoop positioned proximate a perimeter of either drum head of the drum assembly;

a length of flexible conduit fluidly connecting an internal area of said bladder with a remote gas pressure reserve and supply control source;

a gas pressure regulator to control gas pressure within the bladder wherein the gas pressure regulator is controlled by an operator via hand, foot, mouth or electric signal according to the operator preference; and a liquid carbon dioxide or compressed gas cylinder for containing a reserve supply of liquid carbon dioxide or compressed gas at pressures greater than 100 PSIG while including a fixed outlet gas pressure regulator for the delivery of gas at pressures lower than 100 PSIG.

2. The assembly in accordance with claim 1 wherein the bladder is constructed of a commercially available polyurethane tubing that remains flexible while the bladder expands or contracts while containing an elevated internal air pressure ranging between 0- 100 PSIG without allowing any air contained inside said bladder to escape to atmosphere, or cause said bladder to bulge or rupture.

3. The assembly in accordance with claim 1 further comprising a non-distensible, flexible air pressure conduit connection constructed of polyurethane tubing that remains flexible while containing an elevated internal air pressure ranging between 0-100 PSIG without allowing any air contained inside the conduit connection to escape to atmosphere, or cause the conduit connection to bulge or rupture.

4. The assembly in accordance with claim 1 wherein the gas pressure regulator is programmed to provide pre-selected air pressures within the bladder that are adjusted by an electric signal, the gas pressure regulator controllable by either pre-programmed electronic signals or signals produced by the operator in real-time to adjust the drum head tension and thereby adjust the drum head pitch.

5. The assembly in accordance with claim 1 wherein the assembly operates silently or nearly silently to avoid any audible disturbance to musical performances with audible range of the present invention while the present invention is either at rest or in operation.

6. The assembly in accordance with claim 1 wherein the tension is uniformly distributed to the drum head equally 360 degrees near the drum head perimeter, thereby equally distributing the tension to the drum head circumference, thereby equally distributing tension to the entire drum head.

7. The assembly in accordance with claim 1 wherein the 360° continuous distensible bladder compensates for mechanical irregularities that may be present in the drum, the drum hardware or the drum head by virtue of the fluid nature of compressed gas where all forces contained within the bladder apply equally in a 360° continuous nature to all internal surfaces of the bladder and therefore equally to the drum head.

8. The assembly of claim 1 further comprising an internal crush-resistant fitting bonded to the conduit by an adhesive process enabling a flexible mechanical connection of the bladder to all points of contact with the rim and the hoop of the drum assembly.

9. An apparatus for use with an acoustic style musical drum assembly, the drum assembly having at least one drum head, the apparatus to assist in the uniform distribution of tension applied to the at least one drum head for the purpose of producing a clear and uniform frequency pitch when the at least one drum head is struck by an object or sound waves, the drum assembly including a rim and a hoop positioned proximate to the at least one drum head, the apparatus comprising a 360° continuous distensible annular bladder disposed between the rim and the hoop, the bladder conforming its profile shape relative to a regulated delivery of a compressed gas selectively introduced within the bladder at pressures ranging from 0-100 PSIG.

10. The apparatus of claim 9 further comprising a flexible conduit fluidly connecting the bladder with a gas pressure regulator to control gas pressure within the bladder, wherein the flexible conduit is vulcanized bonded to the bladder.

11. The apparatus of claim 10 wherein the gas pressure regulator is controlled by an operator via hand, foot or mouth.

12. The apparatus of claim 10 wherein the gas pressure regulator is controlled by an electric signal.

13. The apparatus of claim 10 further comprising an internal crush-resistant fitting bonded to the conduit to enable a flexible mechanical connection of the bladder to all points of contact with the rim and the hoop of the drum assembly.

14. The apparatus of claim 10 further comprising a gas supply for providing compressed gas at pressures greater than 100 PSIG.

15. An apparatus for use with an acoustic style musical drum assembly, the drum assembly having at least one drum head, the apparatus to assist in the uniform distribution of tension applied to the at least one drum head for the purpose of producing a clear and uniform frequency pitch when the at least one drum head is struck by any object or sound waves, the drum assembly including a rim and a hoop positioned proximate to the at least one drum head, the apparatus comprising:

- a 360° continuous distensible annular bladder disposed between the rim and the hoop; and
- a flexible conduit fluidly connecting the bladder to a gas pressure regulator connected to an external supply of gas, the flexible conduit vulcanized bonded to the bladder to form a seamless connection, wherein the bladder conforms its profile shape in a continuous 360° manner relative to a regulated delivery of a compressed gas selectively introduced within the bladder at pressures ranging from 0-100 PSIG.

16. The assembly of claim 15 and further comprising an internal crush-resistant fitting bonded to the conduit to enable a flexible mechanical connection of the bladder to all points of contact with the rim and the hoop of the drum assembly.

17. The apparatus of claim 15 wherein the gas pressure regulator is controlled by an operator via hand, foot or mouth.

18. The apparatus of claim 15 wherein the gas pressure regulator is controlled by and electric signal.

* * * * *